US008487549B2

(12) United States Patent
Hsieh

(10) Patent No.: US 8,487,549 B2
(45) Date of Patent: Jul. 16, 2013

(54) LIGHT-EMITTING DIODE CONTROL CIRCUIT

(75) Inventor: Ming-Chih Hsieh, Tu-Cheng (TW)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 351 days.

(21) Appl. No.: 12/967,016

(22) Filed: Dec. 13, 2010

(65) Prior Publication Data

US 2012/0112663 A1 May 10, 2012

(51) Int. Cl.
*H05B 37/02* (2006.01)

(52) U.S. Cl.
USPC ..... 315/294; 315/185 R; 315/200 R; 315/201; 315/291; 315/308

(58) Field of Classification Search
USPC ..... 315/122, 185 R, 194, 195, 200 R, 315/201, 291, 294, 308
See application file for complete search history.

(56) References Cited

U.S. PATENT DOCUMENTS

| | | | | |
|---|---|---|---|---|
| 2007/0085786 | A1* | 4/2007 | Lin et al. | 345/82 |
| 2010/0148691 | A1* | 6/2010 | Kuo et al. | 315/291 |
| 2010/0308739 | A1* | 12/2010 | Shteynberg et al. | 315/193 |
| 2011/0062892 | A1* | 3/2011 | Li et al. | 315/307 |
| 2012/0176046 | A1* | 7/2012 | Tsai | 315/185 R |

* cited by examiner

*Primary Examiner* — Douglas W Owens
*Assistant Examiner* — Thai Pham
(74) *Attorney, Agent, or Firm* — Altis Law Group, Inc.

(57) ABSTRACT

A light-emitting diode (LED) control circuit includes a switch, a control signal generating circuit, a voltage conversion device, and N switching circuits. The voltage conversion device converts a first direct current (DC) power supply to a second DC power supply for supplying power to the control signal generating circuit. The control signal generating circuit outputs different control signals according to the switch to turn on or off the N switching circuits, thus power is supplied to corresponding groups of LEDs.

10 Claims, 3 Drawing Sheets

LIGHT-EMITTING DIODE CONTROL CIRCUIT

BACKGROUND

1. Technical Field

The present disclosure relates to a light-emitting diode (LED) control circuit.

2. Description of Related Art

LEDs are used in lighting equipment nowadays. However, lots of lighting equipment has fixed brightness. Users cannot adjust the brightness of the lighting equipment as required.

BRIEF DESCRIPTION OF THE DRAWINGS

Many aspects of the embodiments can be better understood with reference to the following drawings. The components in the drawings are not necessarily drawn to scale, the emphasis instead being placed upon clearly illustrating the principles of the present embodiments. Moreover, in the drawings, like reference numerals designate corresponding parts throughout the several views.

DETAILED DESCRIPTION

The disclosure, including the accompanying drawings, is illustrated by way of example and not by way of limitation. It should be noted that references to "an" or "one" embodiment in this disclosure are not necessarily to the same embodiment, and such references mean at least one.

Figure 1:
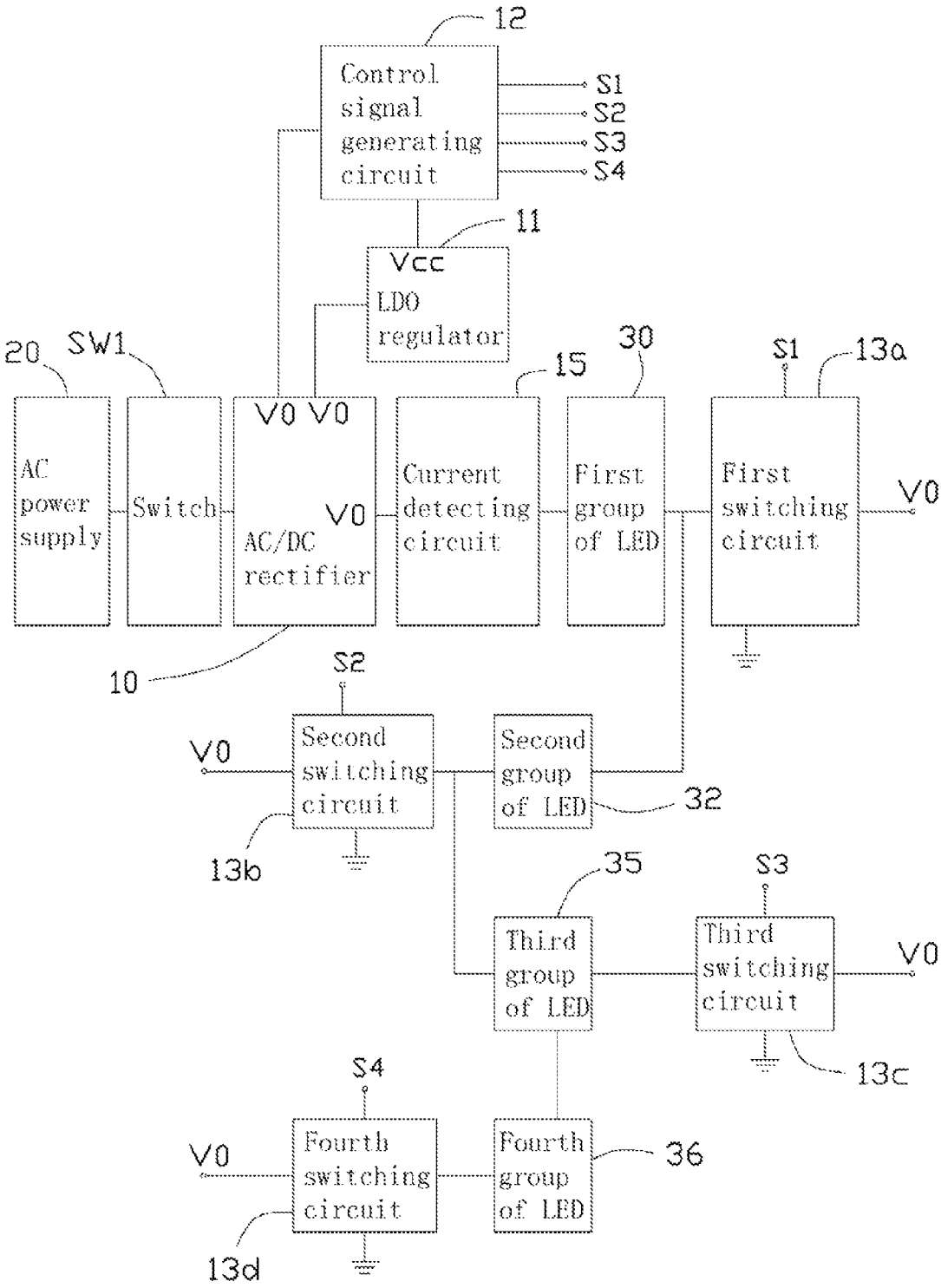
FIG. 1 is a block diagram of a first embodiment of a light-emitting diode (LED) control circuit.
Figure 2:
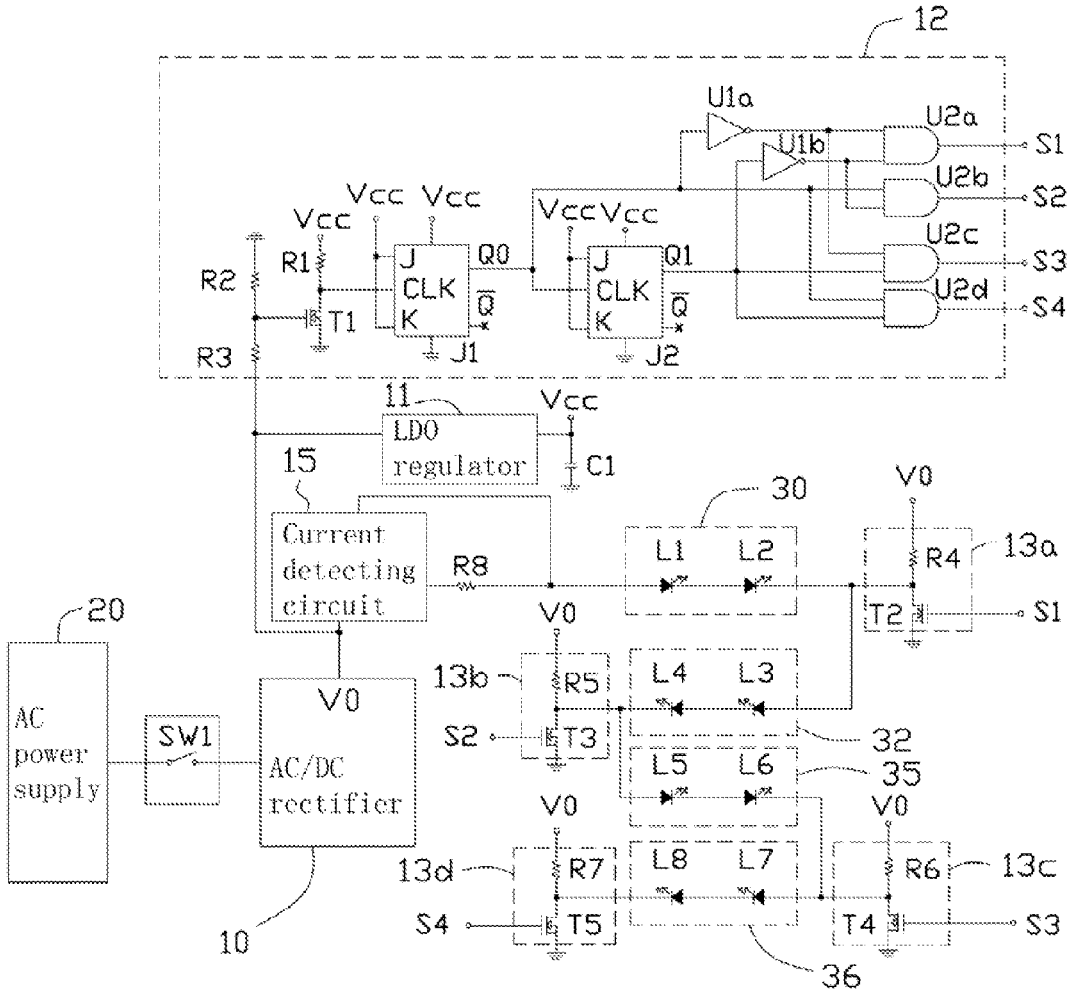
FIG. 2 is a circuit diagram of the LED control circuit of FIG. 1.

Referring to FIGS. 1 and 2, a first embodiment of a light-emitting diode (LED) control circuit is used for adjusting lighting equipment with a plurality of LEDs. The LED control circuit includes a switch SW1, an alternating current to direct current (AC/DC) rectifier 10, a low dropout (LDO) regulator 11, a control signal generating circuit 12, a first switching circuit 13*a*, a second switching circuit 13*b*, a third switching circuit 13*c*, a fourth switching circuit 13*d*, and a current detecting circuit 15.

In the embodiment, the lighting equipment includes eight LEDs L1-L8. The LEDs L1 and L2 are regarded as a first group of LEDs 30. The LEDs L3 and L4 are regarded as a second group of LEDs 32. The LEDs L5 and L6 are regarded as a third group of LEDs 35. The LEDs L7 and L8 are regarded as a fourth group of LEDs 36. An anode of the LED L1 is connected to a first terminal of the current detecting circuit 15 through a resistor R8. A cathode of the LED L1 is connected to an anode of the LED L2. A cathode of the LED L2 is connected to the first switching circuit 13*a* and an anode of the LED L3. A cathode of the LED L3 is connected to an anode of the LED L4. A cathode of the LED L4 is connected to the second switching circuit 13*b* and an anode of the LED L5. A cathode of the LED L5 is connected to an anode of the LED L6. A cathode of the LED L6 is connected to the third switching circuit 13*c* and an anode of the LED L7. A cathode of the LED L7 is connected to an anode of the LED L8. A cathode of the LED L8 is connected to the fourth switching circuit 13*d*. In other embodiments, the lighting equipment may include more or less than four groups of LEDs.

The switch SW1 is connected between an alternating current (AC) power supply 20 and the AC/DC rectifier 10. The AC/DC rectifier 10 rectifies the AC power supply 20 to a direct current (DC) power supply V0. An input of the control signal generating circuit 12 is connected to the AC/DC rectifier 10 to receive the DC power supply V0. The control signal generating circuit 12 outputs control signals according to the DC power supply V0.

The LDO regulator 11 is connected to the AC/DC rectifier 10 for converting the DC power supply V0 to another DC power supply Vcc to supply power to certain components of the control signal generating circuit 12. In other embodiments, other voltage conversion devices may replace the LDO regulator 11.

Four output terminals of the control signal generating circuit 12 are connected to control terminals of the first to fourth switching circuit 13*a*-13*d* correspondingly. A first terminal of the first switching circuit 13*a* is connected to a node between the first group of LEDs 30 and the second group of LEDs 32 (namely a node between the LEDs L2 and L3). A second terminal of the first switching circuit 13*a* receives the DC power supply V0. A third terminal of the first switching circuit 13*a* is grounded. A first terminal of the second switching circuit 13*b* is connected to a node between the second group of LEDs 32 and the third group of LEDs 35 (namely a node between the LEDs L4 and L5). A second terminal of the second switching circuit 13*b* receives the DC power supply V0. A third terminal of the second switching circuit 13*b* is grounded. A first terminal of the third switching circuit 13*c* is connected to a node between the third group of LEDs 35 and the fourth group of LEDs 36 (namely a node between the LEDs L6 and L7). A second terminal of the third switching circuit 13*c* receives the DC power supply V0. A third terminal of the third switching circuit 13*c* is grounded. A first terminal of the fourth switching circuit 13*d* is connected to the cathode of the LED L8. A second terminal of the fourth switching circuit 13*d* receives the DC power supply V0. A third terminal of the fourth switching circuit 13*d* is grounded.

The first to fourth switching circuits 13*a*-13*d* are turned on or off according to control signals from the control signal generating circuit 12. For example, when the first switching circuit 13*a* is turned on, and the second to fourth switching circuits 13*b*-13*d* are turned off, the first group of LEDs 30 (namely the LEDs L1 and L2) are turned on. When the second switching circuit 13*b* is turned on, and the first switching circuit 13*a*, the third switching circuit 13*c*, and the fourth switching circuit 13*d* are turned off, the first and second groups of LEDs 30 and 32 (namely the LEDs L1-L4) are turned on. When the third switching circuit 13*c* is turned on, and the first switching circuit 13*a*, the second switching circuit 13*b*, and the fourth switching circuit 13*d* are turned off, the first, second, and third groups of LEDs 30, 32, and 35 (namely the LEDs L1-L6) are turned on. When the fourth switching circuit 13*d* is turned on, and the first switching circuit 13*a*, the second switching circuit 13*b*, and the third switching circuit 13*c* are turned off, the first to fourth groups of LEDs 30, 32, 35, and 36 (namely the LEDs L1-L8) are turned on. At this time, the lighting equipment has the most brightness.

A second terminal of the current detecting circuit 15 is connected to the AC/DC rectifier 10, for sensing the current flowing through the LEDs. The current detecting circuit 15 further adjusts the current flowing through the LEDs to make the current flowing through the LEDs equal to a predetermined value.

The control signal generating circuit 12 includes a field effect transistor (FET) T1, a first JK flip-flop J1, a second JK flip-flop J2, a first inverter U1*a*, a second inverter U1*b*, a first AND gate U2*a*, a second AND gate U2*b*, a third AND gate U2*c*, and a fourth AND gate U2*d*.

Input terminals J and K of the first JK flip-flop J1 are connected to the DC power supply Vcc. A triggering terminal CLK of the first JK flip-flop J1 is connected to a drain of the FET T1. A first output terminal $\overline{Q}$ is floating. A ground terminal of the first JK flip-flop J1 is grounded. A power terminal of the first JK flip-flop J1 is connected to the DC power supply Vcc. The drain of the FET T1 is connected to the DC power supply Vcc through a resistor R1. A source of the FET T1 is grounded. A resistor R2 and a resistor R3 are connected in series between the AC/DC rectifier 10 and ground. A gate of the FET T1 is connected to a node between the resistor R2 and the resistor R3.

Input terminals of the second JK flip-flop J2 are connected to the DC power supply Vcc. A triggering terminal CLK of the second JK flip-flop J2 is connected to a second output terminal Q0 of the first JK flip-flop J1. A first output terminal $\overline{Q}$ of the second JK flip-flop J2 is floating. A ground terminal of the second JK flip-flop J2 is grounded. A power terminal of the second JK flip-flop J2 is connected to the DC power supply Vcc.

An input terminal of the first inverter U1*a* is connected to the second output terminal Q0 of the first JK flip-flop J1. An output terminal of the first inverter U1*a* is connected to a first input terminal of the first AND gate U2*a*. An input terminal of the second inverter U1*b* is connected to a second output terminal Q1 of the JK flip-flop J2. An output terminal of the second inverter U1*b* is connected to a second input terminal of the first AND gate U2*a*. A first input terminal of the second AND gate U2*b* is connected to the second output terminal Q0 of the first JK flip-flop J1. A second input terminal of the second AND gate U2*b* is connected to the output terminal of the second inverter U1*b*. A first input terminal of the third AND gate U2*c* is connected to the output terminal of the first inverter U1*a*. A second input terminal of the third AND gate U2*c* is connected to the output terminal Q1 of the second JK flip-flop J2. A first input terminal of the fourth AND gate U2*d* is connected to the second output terminal Q0 of the first JK flip-flop J1. A second input terminal of the fourth AND gate U2*d* is connected to the second output terminal Q1 of the second JK flip-flop J2. Output terminals of the first to fourth AND gates U2*a*-U2*d* function as the four output terminals S1-S4, and are connected to the first to fourth switching circuits 13*a*-13*d*.

The first switching circuit 13*a* includes a FET T2. A gate of the FET T2 is connected the first output terminal S1 of the control signal generating circuit 12. A drain of the FET T2 is connected to the DC power supply V0 through a resistor R4. A source of the FET T2 is grounded. The drain of the FET T2 is further connected to a node between the LEDs L2 and L3.

The second switching circuit 13*b* includes a FET T3. A gate of the FET T3 is connected the second output terminal S2 of the control signal generating circuit 12. A drain of the FET T3 is connected to the DC power supply V0 through a resistor R5. A source of the FET T3 is grounded. The drain of the FET T3 is further connected to a node between the LEDs L4 and L5.

The third switching circuit 13*c* includes a FET T4. A gate of the FET T4 is connected the third output terminal S3 of the control signal generating circuit 12. A drain of the FET T4 is connected to the DC power supply V0 through a resistor R6. A source of the FET T4 is grounded. The drain of the FET T4 is further connected to a node between the LEDs L6 and L7.

The fourth switching circuit 13*d* includes a FET T5. A gate of the FET T5 is connected the fourth output terminal S4 of the control signal generating circuit 12. A drain of the FET T5 is connected to the DC power supply V0 through a resistor R7. A source of the FET T5 is grounded. The drain of the FET T5 is further connected to a cathode of the LED L8.

When the switch SW1 is turned on for a first time, the DC power supply V0 is output to the current detecting circuit 15 and the gate of the FET T1. The capacitor C1 is charged by the DC power supply Vcc. At this time, the control signal generating circuit 12 is activated. The FET T1 is turned on. The triggering terminal CLK of the first JK flip-flop J1 receives a low level signal.

When the switch SW1 is turned off, the capacitor C1 supplies power to the control signal generating circuit 12. At this time, the voltage on the capacitor C1 is not enough to turn on the FET T1. The first JK flip-flop J1 receives a high level signal. When the switch SW1 is turned on for a second time, the FET T1 is turned on again. The triggering terminal CLK of the first JK flip-flop J1 receives a low level signal.

The first JK flip-flop J1 and the second JK flip-flop J2 form an adding counter. When the triggering terminal CLK receives a signal on a rising edge, output of the output terminals Q1 and Q0 of the adding counter add one, as shown in the table 1:

TABLE 1

| CLK | 0 | ↑ | ↑ | ↑ | ↑ | ... |
|---|---|---|---|---|---|---|
| Q0 | 0 | 1 | 0 | 1 | 0 | ... |
| Q1 | 0 | 0 | 1 | 1 | 0 | ... |

The first and second inverters U1*a* and U1*b*, and the first to fourth AND gates U2*a*-U2*d* form a 2-to-4 line single bit decoder. The 2-to-4 line single bit decoder converts a 2-bit code to a 4-bit code. The 2-bit code from the output terminals Q1 and Q0 of the adding counter are converted to a 4-bit code. For example, when the adding counter outputs a 2-bit code "00", the 2-bit to 4-bit encoder outputs a 4-bit code "1000". At this time, the FET T2 is turned on, and the FETs T3-T5 are turned off. As a result, the LEDs L1 and L2 are turned on, and the LEDs L3-L8 are not working. The relationship between the triggering terminal CLK of the first JK flip-flop J1, the output terminals Q1 and Q0 of the adding counter, the output terminals S1-S4 of the 2-to-4 line single bit decoder, and the FETs T2-T5 is described as follows:

TABLE 2

| CLK | Q0 | Q1 | S1 | S2 | S3 | S4 | T2 | T3 | T4 | T5 |
|---|---|---|---|---|---|---|---|---|---|---|
| 0 | 0 | 0 | 1 | 0 | 0 | 0 | ON | OFF | OFF | OFF |
| ↑ | 1 | 0 | 0 | 1 | 0 | 0 | OFF | ON | OFF | OFF |
| ↑ | 0 | 1 | 0 | 0 | 1 | 0 | OFF | OFF | ON | OFF |
| ↑ | 1 | 1 | 0 | 0 | 0 | 1 | OFF | OFF | OFF | ON |
| ↑ | 0 | 0 | 1 | 0 | 0 | 0 | ON | OFF | OFF | OFF |
| . | . | . | . | . | . | . | . | . | . | . |
| . | . | . | . | . | . | . | . | . | . | . |
| . | . | . | . | . | . | . | . | . | . | . |

When the switch SW1 is turned on for a first time, the triggering terminal CLK of the first JK flip-flop J1 receives a low level signal. At this time, the first switching circuit 13*a* is turned on, and the second to fourth switching circuits 13*b*-13*d* are turned off. The LEDs L1 and L2 are turned on as a result. When the switch SW1 is turned on once again, the triggering terminal CLK of the first JK flip-flop J1 receives a signal on a rising edge, the second switching circuit 13*b* is turned on, and the first switching circuit 13*a*, the third switching circuit 13*c*, and the fourth switching circuit 13*d* are turned off. The LEDs L1-L4 are turned on as a result. When the switch SW1 is turned on for a third time, the triggering terminal CLK of the first JK flip-flop J1 receives a signal on a rising edge, the third switching circuit 13*c* is turned on, the first switching circuit 13*a*, the second switching circuit 13*b*, and the fourth switching circuit 13*d* are turned off. The LEDs L1-L6 are turned on as a result. When the switch SW1 is turned on for a fourth time, the triggering terminal CLK of the first JK flip-flop J1 receives a signal on a rising edge, the fourth switching circuit 13*d* is turned on, the first switching circuit 13*a*, the second switching circuit 13*b*, and the third switching circuit 13*c* are turned off. The LEDs L1-L8 are turned on as a result.

In the embodiment, the FETs T1-T4 function as switches. In other embodiments, the FETs T1-T4 can be replaced by other elements, such as bipolar transistors.

Figure 3:
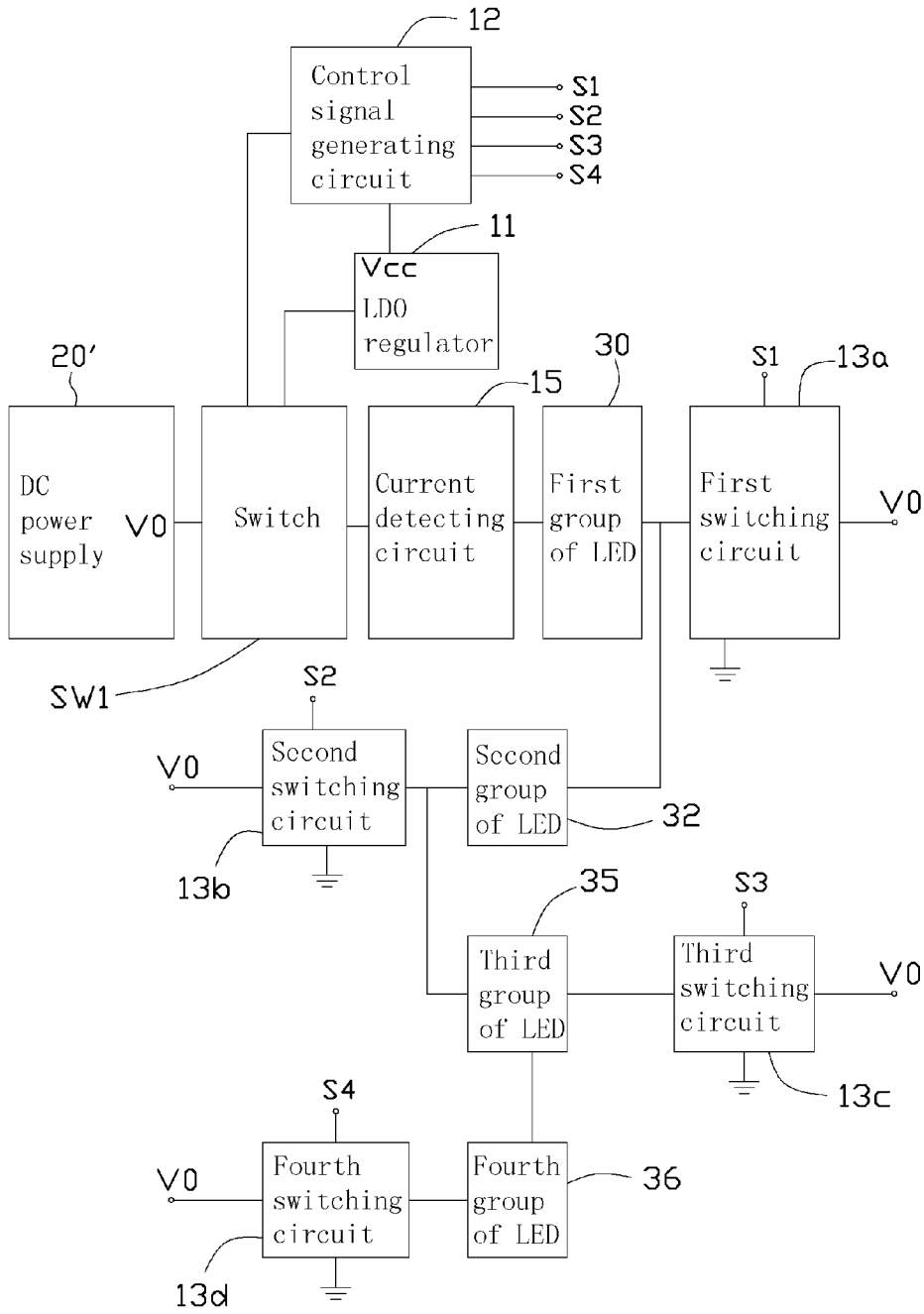
FIG. 3 is a block diagram of a second embodiment of an LED control circuit.

Referring to FIG. 3, in a second embodiment of an LED control circuit, a DC power supply 20' replaces the AC power supply 20 in FIG. 1. Then the AC/DC rectifier 10 in FIG. 1 can be omitted. The switch SW1 is connected between the DC power supply 20' and the current detecting circuit 15. The switch SW1 is further connected to the LDO regulator 11 and the control signal generating circuit 12. With the similar reasons as the first embodiment, the LED control circuit can adjust the brightness of the lighting equipment with N groups of LEDs.

The foregoing description of the embodiments of the disclosure has been presented only for the purposes of illustration and description and is not intended to be exhaustive or to limit the disclosure to the precise forms disclosed. Many modifications and variations are possible in light of the above everything. The embodiments were chosen and described in order to explain the principles of the disclosure and their practical application so as to enable others of ordinary skill in the art to utilize the disclosure and various embodiments and with various modifications as are suited to the particular use contemplated. Alternative embodiments will become apparent to those of ordinary skills in the art to which the present disclosure pertains without departing from its spirit and scope. Accordingly, the scope of the present disclosure is defined by the appended claims rather than the foregoing description and the exemplary embodiments described therein.

What is claimed is:

1. A light-emitting diode (LED) control circuit to adjust brightness of a lighting equipment, the lighting equipment comprising N groups of LEDs connected in series, the LED control circuit comprising:

a switch comprising a first terminal, connected to a first direct current (DC) power supply, and a second terminal;

a control signal generating circuit comprising an input terminal connected to the second terminal of the switch, and N output terminals, N being an integer greater than 1;

a voltage conversion device connected to the second terminal of the switch, wherein the voltage conversion device converts the first DC power supply to a second DC power supply for supplying power to the control signal generating circuit; and N switching circuits, wherein a first terminal of each switching circuit is connected to the first DC power supply, a second terminal of each switching circuit is connected to a corresponding output terminal of the control signal generating circuit, a third terminal of each switching circuit is grounded, the first terminal of the Nth switching circuit is connected to a last terminal of the Nth group of LEDs, the first terminal of each of the remaining N−1 switching circuits is connected to a corresponding node between two adjacent groups of LEDs, the control signal generating circuit outputs different control signals according to the switch to turn on or off the N switching circuits, thus to supply power to the corresponding groups of LEDs;

wherein the control signal generating circuit comprises a first field effect transistor (FET), an adding counter, and a 2-to-N line single bit decoder, a gate of the first FET is grounded through a first resistor, the gate of the first FET is further connected to the second terminal of the switch through a second resistor, a source of the first FET is grounded, a drain of the first FET is connected to the second DC power supply through a third resistor, the drain of the first FET is further connected to an input terminal of the adding counter, first and second output terminals of the adding counter are connected to two input terminals of the 2-to-N line single bit decoder, N output terminals of the 2-to-N line single bit decoder function as the N output terminals of the control signal generating circuit and are connected to the N switching circuits respectively, when the input terminal of the adding counter receives a signal on a rising edge for one time, a two-bit code output from the first and second output terminals of the adding counter adds one, the 2-to-N line single bit decoder converts the two-bit code to an N-bit code.

2. The LED control circuit of claim 1, further comprising a current detecting circuit, wherein a first terminal of the current detecting circuit is connected to a first terminal of a first group of LEDs, a second terminal of the current detecting circuit is connected to the second terminal of the switch, the current detecting circuit senses current flowing through the groups of LEDs and adjusts the current correspondingly, to make the current flowing through the groups of LEDs equal to a predetermined value.

3. The LED control circuit of claim 1, wherein the adding counter comprises a first flip-flop and a second flip-flop, two input terminals of the first flip-flop are connected to the second DC power supply, a triggering terminal of the first flip-flop is connected to the drain of the first FET, an output terminal of the first flip-flop is connected to a first input terminal of the second flip-flop, the output terminal of the first flip-flop functions as the second output terminal of the adding counter and is connected to the 2-to-N line single bit decoder, two input terminals of the second flip-flop are connected to the second DC power supply, an output terminal of the second flip-flop functions as the first output terminal of the adding counter and is connected to the 2-to-N line single bit decoder.

4. The LED control circuit of claim 1, wherein the N switching circuits comprises four switching circuits, the 2-to-N line single bit decoder is a 2-to-4 line single bit decoder, the 2-to-4 line single bit decoder comprises a first inverter, a second inverter, a first AND gate, a second AND gate, a third AND gate, and a fourth AND gate, an input terminal of the first inverter is connected to the second output terminal of the adding counter, an output terminal of the first inverter is connected to a first input terminal of the first AND gate, an input terminal of the second inverter is connected to the first output terminal of the adding counter, an output terminal of the second inverter is connected to a second input terminal of the first AND gate, a first input terminal of the second AND gate is connected to the second output terminal of the adding counter, a second input terminal of the second AND gate is connected to the output terminal of the second inverter, a first input terminal of the third AND gate is connected to the output terminal of the first inverter, a second input terminal of the third AND gate is connected to the first output terminal of the adding counter, a first input terminal of the fourth AND gate is connected to the second output terminal of the adding counter, a second input terminal of the fourth AND gate is connected to the first output terminal of the adding counter, output terminals of the first to fourth AND gates function as the four output terminals of the 2-to-4 line single bit decoder and are connected to the four switching circuits respectively.

5. The LED control circuit of claim 1, wherein each switching circuit comprises a second FET, a gate of the second FET is connected to a corresponding output terminal of the 2-to-4 line single bit decoder, a source of the second FET is grounded, a drain of the second FET is connected to the second DC power supply through a fourth resistor, the drain of the second FET in each of the remaining N−1 switching circuits is further connected to a node between two adjacent groups of LEDs correspondingly, the drain of the second FET in the Nth switching circuit is connected to the last terminal of the Nth group of LEDs.

6. A light-emitting diode (LED) control circuit to adjust brightness of a lighting equipment, the lighting equipment comprising N groups of LEDs connected in series, the LED control circuit comprising:

a switch comprising a first terminal connected to an alternating current (AC) power supply, and a second terminal;

an alternating current to direct current (AC/DC) rectifier comprising an input terminal connected to the second terminal of the switch, and an output terminal, wherein the AC/DC rectifier rectifies the AC power supply to a first direct current (DC) power supply;

a control signal generating circuit comprising an input terminal connected to the output terminal of the AC/DC rectifier, and N output terminals, N being an integer greater than 1;

a voltage conversion device connected to the output terminal of the AC/DC rectifier, wherein the voltage conversion device converts the first DC power supply to a second DC power supply for supplying power to the control signal generating circuit; and N switching circuits, wherein a first terminal of each switching circuit receives the first DC power supply, a second terminal of each switching circuit is connected to a corresponding output terminal of the control signal generating circuit, a third terminal of each switching circuit is grounded, the first terminal of the Nth switching circuit is connected to a last terminal of the Nth group of LEDs, the first terminal of each of the respective N−1 switching circuits is connected to a corresponding node between two adjacent groups of LEDs, the control signal generating circuit outputs different control signals according to the switch to turn on or off the N switching circuits, thus to supply power to the corresponding groups of LEDs wherein the control signal generating circuit comprises a first field effect transistor (FET), an adding counter, and a 2-to-N line single bit decoder a gate of the first FET is rounded through a first resistor, the gate of the first FET is further connected to the output terminal of the AC/DC rectifier through a second resistor, a source of the first FET is grounded, a drain of the first FET receives the second DC power supply, the drain of the first FET is further connected to an input terminal of the adding counter, first and second output terminals of the adding counter are connected to two input terminals of the 2-to-N line single bit decoder, N output terminals of the 2-to-N line single bit decoder function as the N output terminals of the control signal generating circuit and are connected to the N switching circuits respectively, when the input terminal of the adding counter receives a signal on a rising edge for one time, a two-bit code output from the first and second output terminals of the adding counter adds one, the 2-to-N line single bit decoder converts the two-bit code to an N-bit code.

7. The LED control circuit of claim 6, further comprising a current detecting circuit, wherein a first terminal of the current detecting circuit is connected to a first terminal of a first group of LEDs, a second terminal of the current detecting circuit is connected to the output terminal of the AC/DC rectifier, the current detecting circuit senses current flowing through the groups of LEDs and adjusts the current correspondingly, to make the current flowing through the groups of LEDs equal to a predetermined value.

8. The LED control circuit of claim 6, wherein the adding counter comprises a first flip-flop and a second flip-flop, two input terminals of the first flip-flop receive the second DC power supply, a triggering terminal of the first flip-flop is connected to the drain of the first FET, an output terminal of the first flip-flop is connected to a triggering terminal of the second flip-flop, the output terminal of the first flip-flop functions as the second output terminal of the adding counter and is connected to the 2-to-N line single bit decoder, two input terminals of the second flip-flop receive the second DC power supply, an output terminal of the second flip-flop functions as the first output terminal of the adding counter and is connected to the 2-to-N line single bit decoder.

9. The LED control circuit of claim 6, wherein the N switching circuits comprises four switching circuits, the 2-to-N line single bit decoder is a 2-to-4 line single bit decoder, the 2-to-4 line single bit decoder comprises a first inverter, a second inverter, a first AND gate, a second AND gate, a third AND gate, and a fourth AND gate, an input terminal of the first inverter is connected to the second output terminal of the adding counter, an output terminal of the first inverter is connected to a first input terminal of the first AND gate, an input terminal of the second inverter is connected to the first output terminal of the adding counter, an output terminal of the second inverter is connected to a second input terminal of the first AND gate, a first input terminal of the second AND gate is connected to the second output terminal of the adding counter, a second input terminal of the second AND gate is connected to an output terminal of the second inverter, a first input terminal of the third AND gate is connected to the output terminal of the first inverter, a second input terminal of the third AND gate is connected to the first output terminal of the adding counter, a first input terminal of the fourth AND gate is connected to the second output terminal of the adding counter, a second input terminal of the fourth AND gate is connected to the first output terminal of the adding counter, output terminals of the first to fourth AND gates function as four output terminals of the two-bit to four-bit encoder and are connected to the four switching circuits respectively.

10. The LED control circuit of claim 6, wherein each switching circuit comprises a second FET, a gate of the second FET is connected to a corresponding output terminal of the 2-to-N line single bit decoder, a source of the second FET is grounded, a drain of the second FET is connected to the second DC power supply through a fourth resistor, the drain of each second FET in each of the respective N−1 switching circuits is further connected to a node between two adjacent groups of LEDs correspondingly, the drain of the second FET in the Nth switching circuit is connected to the last terminal of the Nth group of LEDs.

* * * * *